US005503797A

United States Patent [19]

Zoch et al.

[11] Patent Number: 5,503,797

[45] Date of Patent: Apr. 2, 1996

[54] STAINLESS STEEL FOR CASE HARDENING WITH NITROGEN

[75] Inventors: Hans-Werner Zoch, Schonungen; Hans Berns, Bochum, both of Germany

[73] Assignee: FAG Kugelfischer Georg Schafer Aktiengesellschaft, Germany

[21] Appl. No.: 417,801

[22] Filed: Apr. 6, 1995

[30] Foreign Application Priority Data

Apr. 6, 1994 [DE] Germany ..... 44 11 795.7

[51] Int. Cl.[6] ..... C22C 38/52

[52] U.S. Cl. ..... 420/38

[58] Field of Search ..... 420/38; 148/325, 148/326, 906, 904

[56] References Cited

U.S. PATENT DOCUMENTS 5,310,431 5/1994 Buck ..... 148/326

5,358,577 10/1994 Uehara et al. ..... 148/326

FOREIGN PATENT DOCUMENTS 215843 1/1957 Australia ..... 420/38

*Primary Examiner*—Deborah Yee

*Attorney, Agent, or Firm*—Ostrolenk, Faber, Gerb & Soffen

[57] ABSTRACT

In order to obtain high resistance to corrosion of the surface layer in a stainless steel for case hardening with nitrogen, the steel contains the following alloy components (wt. %):

| | |
|---|---|
| C | ≦0.03 |
| N | 0.05 to 0.18 |
| Si | ≦1.0 |
| Mn | ≦1.5 |
| Co | 1.0 to 4.0 |
| Cr | 11 to 16 |
| Ni | 1.0 to 3.0 |
| Mo | 0.5 to 2.5 |
| V | ≦0.4 |

6 Claims, 4 Drawing Sheets

STAINLESS STEEL FOR CASE HARDENING WITH NITROGEN

BACKGROUND OF THE INVENTION

The present invention relates a stainless steel for case hardening with nitrogen.

Case-hardened steels generally have a low content of alloy and contain, for instance, 0.15 to 0.20 wt. % carbon. By surface carburizing to 0.5 to 1.0 wt. % C, followed by hardening, structural parts having a tough core and a hard, wear-resistant surface layer which is under internal compressive stresses are obtained. This condition of internal stressing leads to an increase in the static and cyclical strength of structural parts such as gears and ball bearings, for example.

Stainless structural parts are desired in certain fields of use. Thus, for instance, ball bearings for airplanes are made of case-hardened stainless steels such as, for instance, X 105 CrMo 17 (AISI 440 C). In order to increase the static and cyclic strength of stainless structural parts, a stainless case-hardened steel which contains the following alloy components (wt. %)

| | |
|---|---|
| C | 0.05–0.1 |
| Mn | ≦1.5 |
| Si | ≦1 |
| Cr | 11–15 |
| Mo | 1–3 |
| Ni | 1.5–3.5 |
| Co | 3–8 |
| V | 0.1–1 |
| N | ≦0.04 |

has been developed (see EP 0 411 931 A1).

Chromium and molybdenum impart resistance to rusting to this steel. Manganese, nickel and cobalt serve, in known manner, to suppress δ-ferrite in the core, and vanadium promotes the resistance to tempering. As a result of the high alloy content, the mixed-crystal hardness in the core increases, so that a smaller content of carbon is necessary for establishing the core hardness than in the case of low-alloy case-hardened steels. Nitrogen is preferably limited to ≦0.002 wt. %. Structural parts of this steel are case hardened with carbon.

Federal Republic of Germany 40 33 706 C2 describes a method for the heat treatment of stainless martensitic steels in which the carbonizing is replaced by nitriding. Nitrogen, like carbon, is capable of increasing the surface hardness, but it promotes the chemical resistance of the martensite while carbon decreases it. Case hardening with nitrogen therefore gives the highest resistance to corrosion of the surface layer if it is practically free of carbon.

SUMMARY OF THE INVENTION

The object of the present invention is to create a stainless martensitic steel for case hardening with nitrogen.

This object is achieved by an alloy composition of

| | |
|---|---|
| C | ≦0.03 |
| N | 0.05 to 0.18 |
| Si | ≦1.0 |
| Mn | ≦1.5 |
| Co | 1.0 to 4.0 |
| Cr | 11 to 16 |
| Ni | 1.0 to 3.0 |
| Mo | 0.5 to 2.5 |

-continued

| | |
|---|---|
| V | ≦0.4. |

Advantageous special alloy compositions contain:

| | |
|---|---|
| C | ≦0.02 |
| N | 0.05 to 0.11 |
| Si | ≦0.3 |
| Mn | ≦0.3 |
| Co | 2.0 to 3.0 |
| Cr | 11.5 to 13.5 |
| Ni | 1.5 to 2.8 |
| Mo | 1.0 to 2.0 |
| V | 0.1 to 0.2 |
| or | |
| C | ≦0.02 |
| N | 0.12 to 0.18 |
| Si | ≦0.5 |
| Mn | ≦0.5 |
| Co | 1.0 to 2.0 |
| Cr | 11.5 to 13.5 |
| Ni | 1.2 to 2.5 |
| Mo | 1.0 to 2.0 |
| V | 0.1 to 0.2. |

Compared to EP 0 411 931 A1, the present invention replaces carbon in the alloy by nitrogen, corresponding the replacement of carburizing by nitriding upon the case hardening of steel.

The first step in this connection is dispensing with carbon in order to achieve by case hardening with nitrogen the greatest possible resistance to corrosion. The carbon content of the new steel is therefore limited to the low content of ≦0.03 wt. %, and preferably ≦0.02 wt. %, which can be obtained at reasonable cost. In this way, there results an undesired loss of core hardness and an increase of δ-ferrite. The second step consists in the alloying of nitrogen in order to compensate for these changes. In this way, the core hardness is again brought into the desired region and δ-ferrite is destabilized.

The new steel is made stainless by 11–16 wt. % chromium and 0.5–2.5 wt. % molybdenum. Silicon is limited to ≦1 wt. %. These δ-ferrite stabilizing elements must be counteracted by destabilizing elements such as nitrogen, manganese, nickel, and cobalt in order to obtain a fully martensitic core structure. Nitrogen predominantly determines the amount of the core hardness and is limited to 0.05–0.18 wt. %. Manganese and nickel promote the amount of residual austenite in the case hardened surface, this being true to a lesser extent of cobalt. The contents of these elements are fixed at ≦ 1.5 wt. % manganese, 1–3 wt. % nickel, and 1–4 wt. % cobalt. Up to 0.4 wt. % vanadium is added if the steel is to have greater resistance to tempering. A substantially δ-ferrite-free core structure is obtained by the following relationship:

Wt. % Cr+1.4 wt. % Mo+1.2 wt. % Si+1.8 wt. % V−25 wt. % C−17 wt. % N−1.2 wt. % Ni−0.6 wt. % Co−0.2 wt. % Mn−10≦0.

The steel of the invention is produced by ingot casting and with a nitrogen content ≧0.12 wt. %, preferably by methods of pressure of powder metallurgy. After the hot forming and soft annealing to a hardness of ≦270 HV30, the steel can be machined. Structural parts which are close to the final shape are surface nitrided in nitrogen gas or gas mixtures at a temperature of between 1050° and 1200° C., and preferably 1100° to 1150° C., and a nitrogen partial pressure of between 0.5 and 3 bar, and subjected to direct, single or double hardening followed by deep cooling. This is followed by tempering at a temperature between 150° and 500° C., the secondary maximum being obtained at between 430° and 470° C. In the case of parts with narrow tolerances and those in connection with which there are high demands on the quality of the surface, this is followed by a final machining by grinding.

The nitrogen-containing stainless case-hardened steel in accordance with the invention will be described below and compared with carbon-containing variants.

Other features and advantages of the present invention will become apparent from the following description of the invention which refers to the accompanying drawings.

Steel A of the invention case hardened with nitrogen, known Steel B case hardened with carbon, known Steel C hardened throughout.

Figure 4:
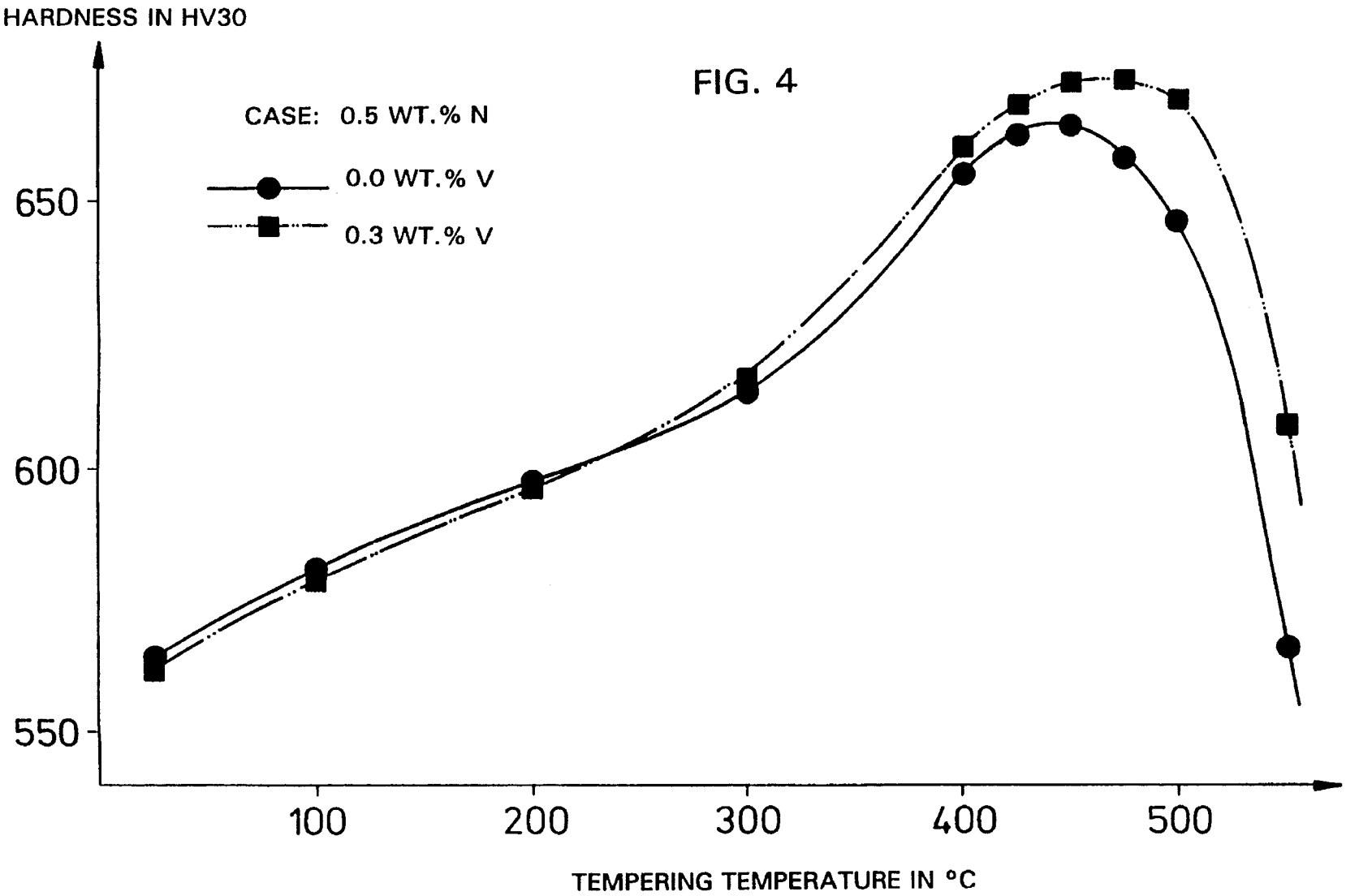

FIG. 4 shows the influence of alloying with 0.3 wt. % vanadium on the secondary hardening in the surface layer of the steel of the invention after the case hardening with nitrogen.

DETAILED DESCRIPTION OF EMBODIMENTS OF THE INVENTION

Figure 1:
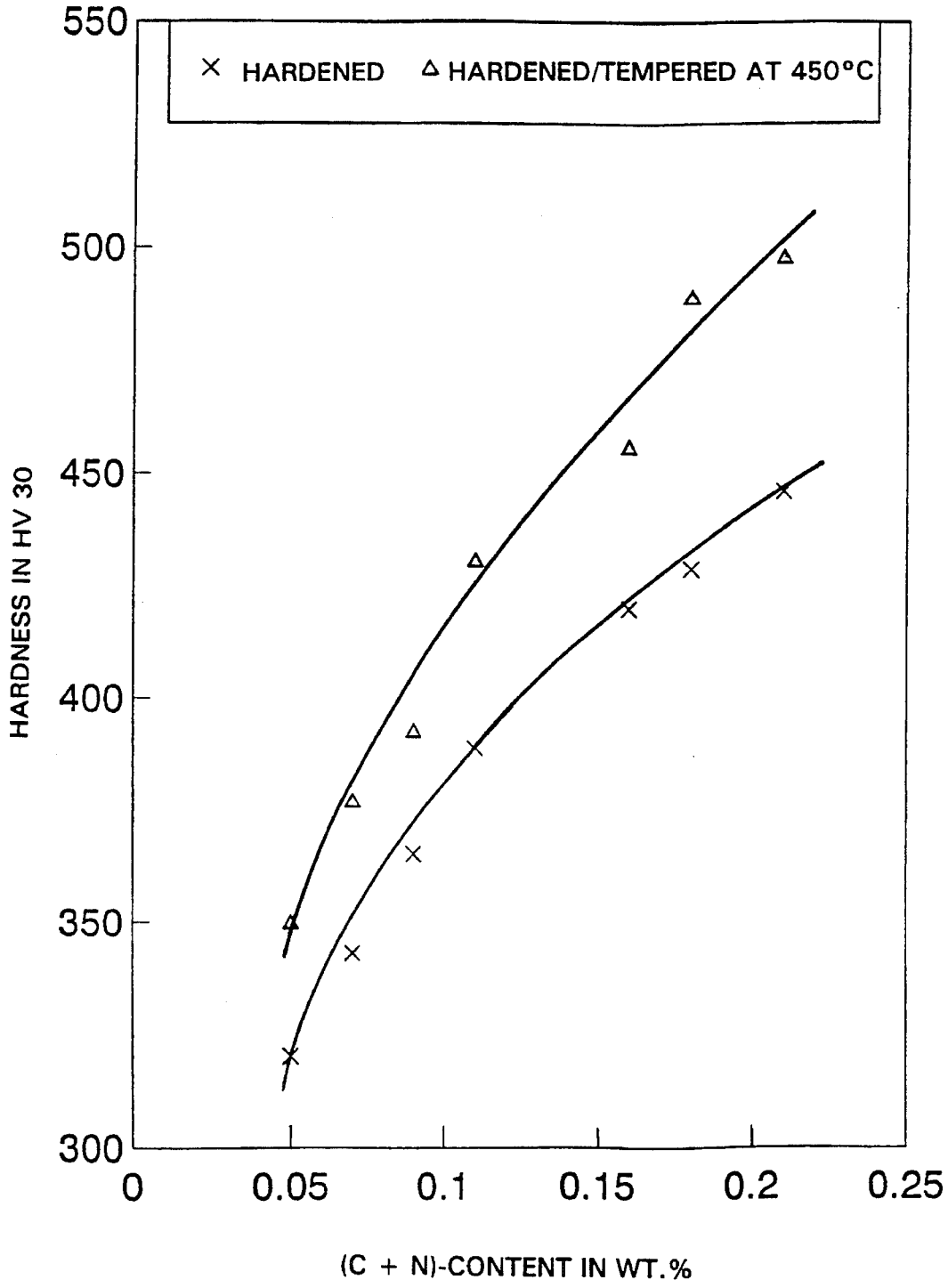
FIG. 1 shows the influence of the nitrogen content on the hardness of the core of the steel of the invention.

FIG. 1 shows the influence of the nitrogen content on the core hardness of the steel of the invention (a) after the nitriding, direct hardening and deep cooling, as well as (b) after the tempering in the secondary hardening maximum at 450° C. The case hardness for (a) is 570 to 630 HV 0.1 and for (b) 670 to 730 HV 0.1. Less than 0.05 wt. % nitrogen decreases the core hardness to a value which is unsuitable, for instance, for anti-friction bearings. More than 0.18 wt. % nitrogen reduces the toughness in the core and permits the desired difference between core and case hardness to decrease to too small a value. Between 0.05 and 0.18 wt. % nitrogen, there is a spread of more than 100 HV 30 core hardness. This spread can be reduced by dividing the nitrogen content in (c) 0.05 to 0.11 wt. % and (d) 0.12 to 0.18 wt. %. Variant (c) is suitable for structural parts of low core hardness and variant (d) for structural parts of high core hardness.

Figure 2A:
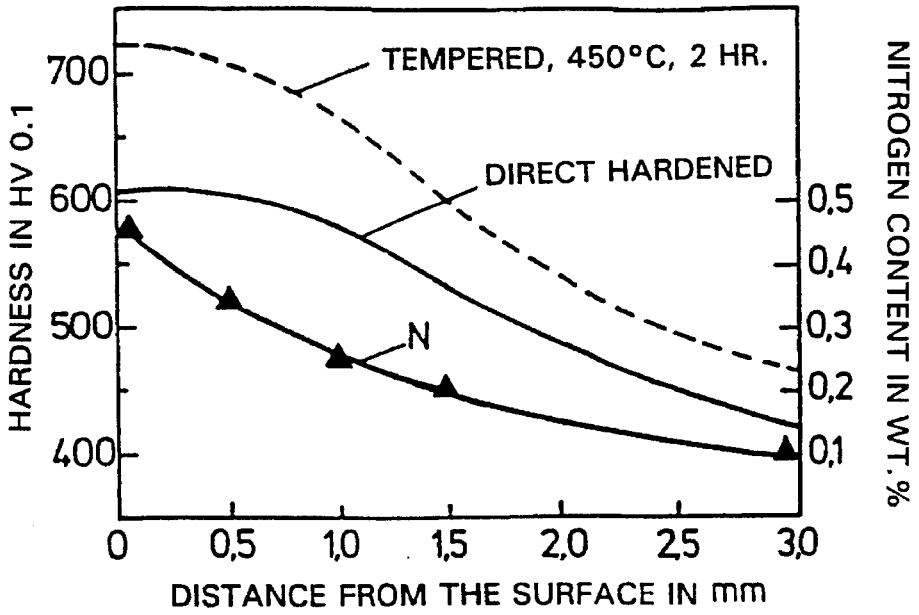
FIG. 2 shows the result of the case hardening with nitrogen for the steel A of the invention a) Change of the nitrogen content and the hardness in the surface layer b) Change of the internal stress in the surface layer determined by X-ray.
Figure 2B:
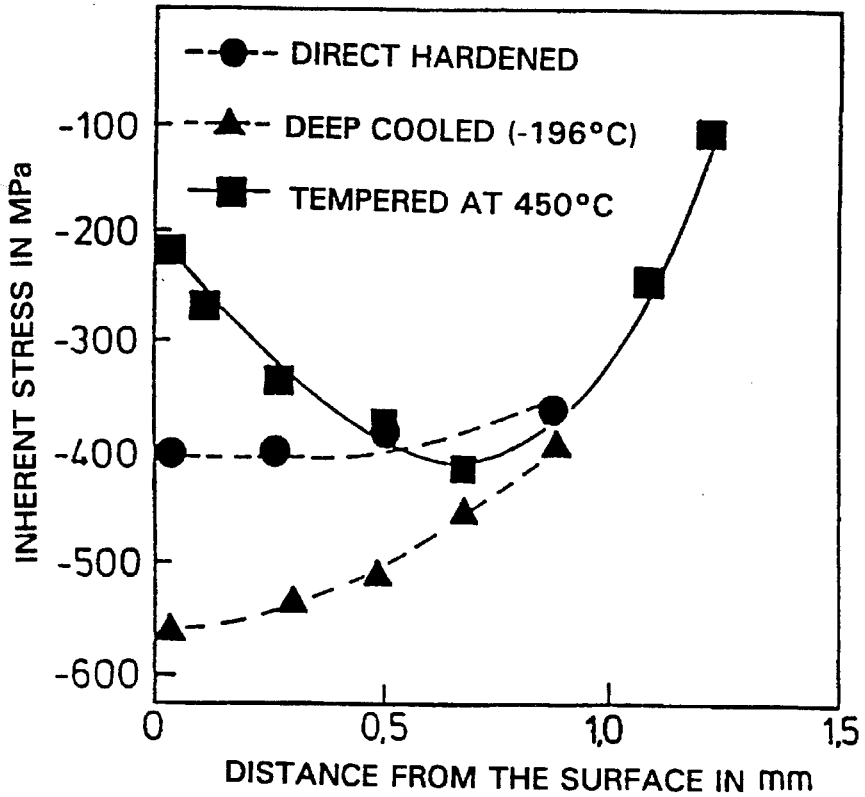

FIGS. 2*a* and 2*b* shows the result of the case hardening with nitrogen for the steel A of the invention, the chemical composition of which is compared further below with the known steels B and C. From FIG. 2*a* it can be noted that upon nitriding a nitrogen content of about 0.5 wt. % is obtained on the surface, decreasing towards the inside to a core value of 0.11 wt. %. The case hardness also decreases in corresponding manner with the distance from the surface to the core hardness. The tempering in the secondary hardening maximum at 450° C. produces an increase in hardness. FIG. 2*b* shows the change of the intrinsic stress, determined by X-ray, in the nitrided case after the individual steps of the heat treatment, such as direct hardening, deep cooling, and tempering. The inherent compressive stress in the case which is desired upon case hardening is obtained also upon the case hardening with nitrogen.

Figure 3:
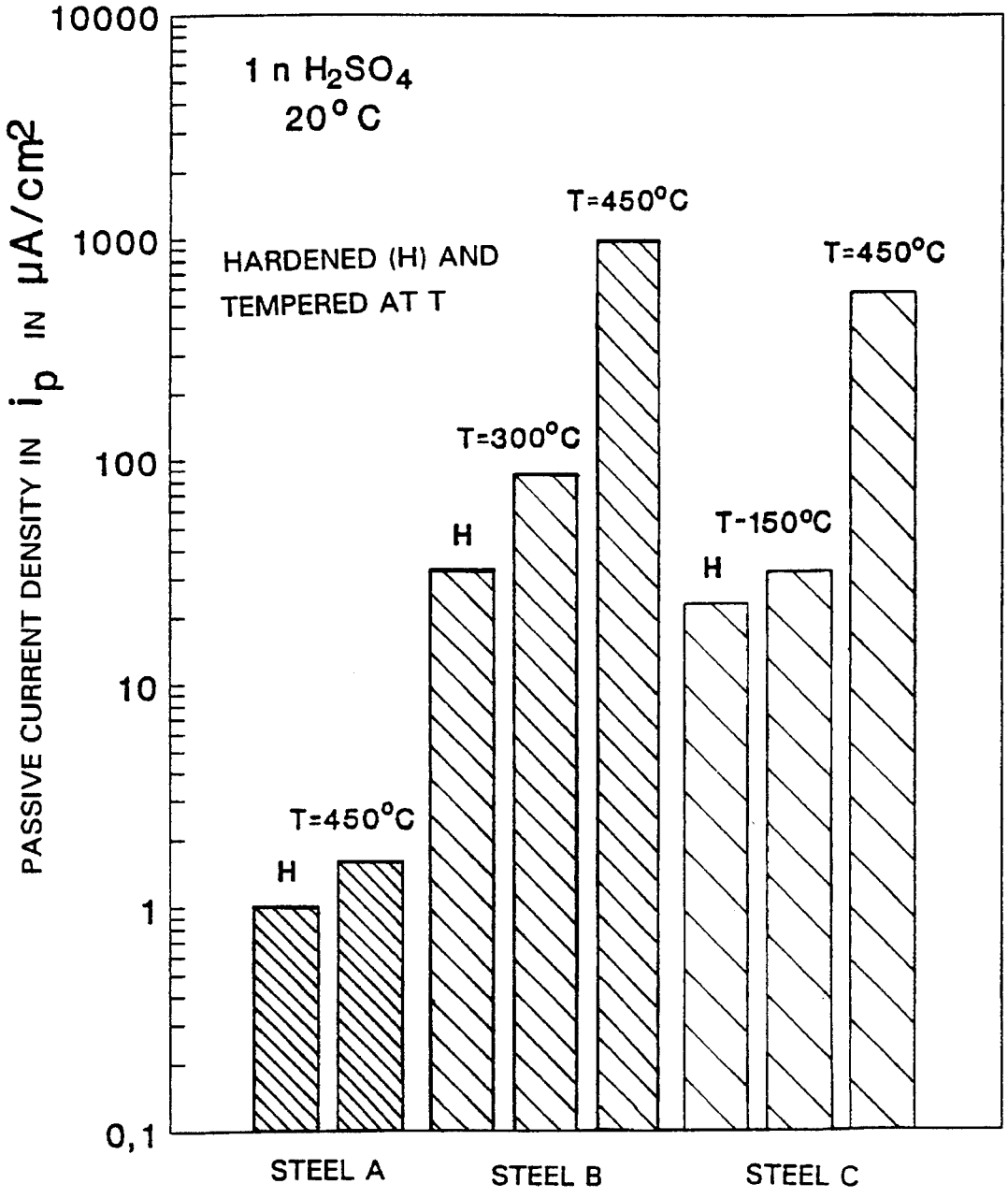
FIG. 3 shows the passive current intensity as measure of the corrosion rate in dilute sulfuric acid.

FIG. 3 shows the superiority of the steel of the invention with respect to its resistance to corrosion, which can be expressed, for instance, by the passive current density $i_p$; the smaller $i_p$, the greater the resistance. The nitrogen-containing stainless steel A of the invention case hardened with nitrogen, a carbon-containing stainless steel B case hardened with carbon, and the through-hardened stainless anti-friction-bearing steel C (X 105 CrMo 17 or AISI 440 C) are compared with the following alloy components in wt. %:

| | Steel A | Steel B | Steel C |
|---|---|---|---|
| Carbon | 0.02 | 0.08 | 1.03 |
| Nitrogen | 0.11 | — | — |
| Silicon | 0.2 | 0.37 | 0.72 |
| Manganese | 0.2 | 0.67 | 0.58 |
| Chromium | 13.2 | 13.00 | 16.9 |
| Molybdenum | 1.6 | 1.77 | 0.55 |
| Nickel | 2.0 | 2.59 | — |
| Cobalt | 2.2 | 5.35 | — |
| Vanadium | 0.12 | 0.58 | — |

While B in the corrosion test (IN $H_2SO_4$) shows a corrosion resistance which is approximately comparable to C, the steel A of the invention is better by about one order of magnitude both in hardened state and in tempered state. After the tempering, A is still as stable as C after the hardening.

The secondary hardening maximum of the steel of the invention can be increased by vanadium and shifted towards higher tempering temperature.

FIG. 4 shows the effect of 0.3 wt. % vanadium. The resistance to tempering, increased by vanadium, of the case nitrided to 0.5 wt. % results in a greater resistance to heat. Thus, the hardness of the vanadium-containing steel is still unchanged after, for instance, heating for 1000 hours at 370° C. Together with the comparatively good resistance to corrosion after the tempering, there is thus obtained a substantially better suitability of steel A upon alternate stressing by wet corrosion and an operating temperature increased to about 350° C.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A stainless steel for case hardening with nitrogen, characterized by the fact that it contains the following alloy components (wt. %):

| | |
|---|---|
| C | ≦0.03 |
| N | 0.05 to 0.18 |
| Si | ≦1.0 |
| Mn | ≦1.5 |
| Co | 1.0 to 4.0 |
| Cr | 11 to 16 |
| Ni | 1.0 to 3.0 |
| Mo | 0.5 to 2.5 |
| V | ≦0.4 |

2. A steel according to claim 1 of low core hardness, characterized by the fact that it contains the following alloy components (wt. %):

| | |
|---|---|
| C | ≦0.02 |
| N | 0.05 to 0.11 |
| Si | ≦0.3 |
| Mn | ≦0.3 |
| Co | 2.0 to 3.0 |
| Cr | 11.5 to 13.5 |
| Ni | 1.5 to 2.8 |
| Mo | 1.0 to 2.0 |
| V | 0.1 to 0.2 |

3. A steel according to claim 1 of high core hardness, characterized by the fact that it contains the following alloy components (wt. %):

| | |
|---|---|
| C | ≦0.02 |
| N | 0.12 to 0.18 |
| Si | ≦0.5 |
| Mn | ≦0.5 |
| Co | 1.0 to 2.0 |
| Cr | 11.5 to 13.5 |

-continued

| | |
|---|---|
| Ni | 1.2 to 2.5 |
| Mo | 1.0 to 2.0 |
| V | 0.1 to 0.2 |

4. In a method for the production of stainless parts for anti-friction bearings, ball screws, gears and shafts with integrated toothing or travel paths, utilizing a steel according to claim 1.

5. In a method for the production of stainless parts for anti-friction bearings, ball screws, gears and shafts with integrated toothing or travel paths, utilizing a steel according to claim 2.

6. In a method for the production of stainless parts for anti-friction bearings, ball screws, gears and shafts with integrated toothing or travel paths, utilizing a steel according to claim 3.

* * * * *